United States Patent [19]

Palmer

[11] Patent Number: 4,945,189

[45] Date of Patent: Jul. 31, 1990

[54] ASYMMETRIC AUDIO CABLE FOR HIGH FIDELITY SIGNALS

[76] Inventor: Donald E. Palmer, #189 1275 Vicente Ave., Sunnyvale, Calif. 94086

[21] Appl. No.: 391,768

[22] Filed: Aug. 9, 1989

[51] Int. Cl.[5] ..... H01B 11/00

[52] U.S. Cl. ..... 174/32; 174/34; 333/236

[58] Field of Search ..... 174/32, 34, 36; 333/236; 307/147, 148

[56] References Cited

U.S. PATENT DOCUMENTS

| | | | |
|---|---|---|---|
| 240,599 | 4/1881 | Lugo | 174/34 |
| 244,167 | 7/1881 | Ball | 174/34 |
| 304,759 | 9/1884 | Shaffer | 174/34 |
| 1,795,209 | 3/1931 | Haugwitz | 174/34 |
| 2,958,724 | 11/1960 | Milloit | 174/34 |
| 4,538,023 | 8/1985 | Brisson | 174/115 |
| 4,754,102 | 6/1988 | Dzurak | 174/36 |

*Primary Examiner*—Morris H. Nimmo

*Attorney, Agent, or Firm*—Townsend and Townsend

[57] ABSTRACT

An interconnection cable for audio frequency high fidelity applications comprises a first and a second conductor which are disposed close to one another and connected at the ends, wherein the second conductor has an electrical length which is a least three times longer than the first conductor. The second conductor is helically wound about the first conductor. A third conductor may be included in the space within the helical winding, and in one embodiment may be connected at the ends of the first and second conductor. In another embodiment, the third conductor may be insulated from the first conductor and the second conductor for signal return.

11 Claims, 3 Drawing Sheets

ASYMMETRIC AUDIO CABLE FOR HIGH FIDELITY SIGNALS

BACKGROUND OF THE INVENTION

This invention relates to audio high fidelity cables or transmission lines wherein the wavelengths of signals carried on the transmission lines are generally longer than the length of the transmission lines, such as in audio signal and high fidelity sound reproduction applications. The invention has particular application where the range of frequencies is greater than several octaves and therefore wherein spurious oscillations (ringing) and broadband random noise carried on the transmission line can have potentially significant impact on the fidelity of a complex signal carried by the transmission line.

In contrast to long transmission lines where the impedance of the cable is matched to the impedance of the termination loads, it is conventional in short transmission lines to reduce the impedance, and more particularly the resistance, of the cable to a minimum to reduce the electrical resistive loss in the cable. When used in high fidelity audio signal interconnection cabling, as between components in an audio component system, such an approach introduces secondary problems, such as audible enhancement of the "brightness" frequencies (1000 Hz to 2000 Hz range) and can cause distortion in the desired audio frequency signals. The primary causes of these effects appear to be radio-frequency noise and spurious oscillation (ringing) in the interconnect cables due to end to end resonances.

It is common practice in audio frequency circuitry to provide either a twisted or parallel pair of signal conductors between subsystems and within components of an audio system. A typical configuration for a current-carrying (1–20 Amperes) loudspeaker connection is a pair of stranded, large gauge (10–16 ga.) wires terminating in a low-impedance (4–16 Ohm) load at the loudspeaker.

Radio frequency noise which is internally generated in audio equipment can be conducted into the signal cable, and can cause spurious oscillations (ringing) and modal resonances in the cable. When the length of the signal lead and the signal return lead are substantially equal, then the natural length-wise mode of ringing in each element is nearly the same, which can result in efficient tuned coupling between the two leads and can cause an increase in the amplitude of the ringing. This is an undesirable condition.

The sources of the radio frequency noise may be either internal (in an amplifier for example) or external (in a television set). The radio frequency noise can cause oscillations and modal resonances in cables and is believed to result in undesired enhancement in the "brightness" frequencies (1000 Hz 2000 Hz range). These effects are undesirable if accurate reproduction of recorded music and the like is desired.

Other cabling schemes are known wherein conductors of slightly different lengths are provided. U.S. Pat. No. 4,538,023 to Brisson illustrates an audio cable wherein conductors of slightly different physical length are provided for the stated purpose of conveying signals of different frequencies having different velocities through appropriate conductors so as to equalize transit times between ends. Brisson has stated that the skin effect is used to this end. Thus, such cables are intended to have the same signal length. By contrast, the present invention relates to a cable wherein the conductors have substantially different signal lengths.

U.S. Pat. No. 4,754,102 to Dzurak discloses a directionally-sensitive audio signal transmission cable which uses multiple conductors which are insulated from one another but which are electrically connected at each end. The uniqueness lies in the fact that less than all of the conductors connected at the source terminal are connected at the destination terminal. The lengths of all conductors are substantially identical. Again by contrast, the present invention relates to a cable wherein the conductors have substantially different signal lengths and all of the conductors connected at the source end are also connected at the destination end.

SUMMARY OF THE INVENTION

According to the invention, an interconnection cable for audio frequency high fidelity applications comprises first or primary electrical wire conductor and at least one second or secondary electrical wire conductor which are disposed close to one another, wherein the second conductor is helically wound around the first conductor and has a signal length which is at least three times and preferably at least five times longer than the signal length of the first conductor, the first wire conductor and the second wire conductor being electrically connected to one another only at each end. Specific embodiments include a helically-wound conductor surrounding a single conductor or multiple conductor twisted pair or transmission line in which the helically-wound conductor is terminated at each end to one or more of the transmission line conductors.

It has been discovered that end to end resonance or the longitudinal ringing mode in audio interconnect cables is substantially reduced when the lengths of each one of the paired conductors differ substantially from one another. It is believed that this is a result of the mismatch of the transit time of signals between the terminations, which differ substantially from one another. Where conductors of substantially-different length are closely spaced, the natural length-wise resonances are believed not to reinforce one another due to close coupling, thereby resulting in reduced amplitude of ringing.

While there are other structures which suppress cable ringing effects, structures in accordance with the invention are an inexpensive yet effective alternative.

The invention will be better understood by reference to the following detailed description taken in conjunction with the accompanying drawings.

DESCRIPTION OF SPECIFIC EMBODIMENTS

Figure 1:
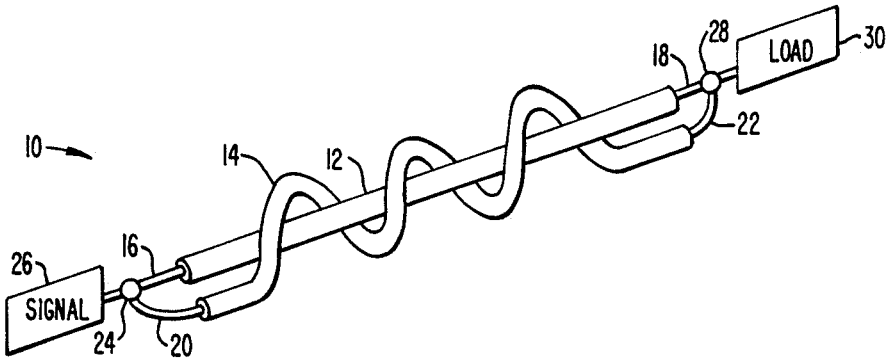
FIG. 1 is a side view of a dual wire, single conductor cable constructed in accordance with the invention.

FIG. 1, a cable 10 according to the invention comprises a first or primary conductor 12 and a second or secondary conductor 14. The first conductor 12 has a first end 16 and a second end 18. The second conductor 14 has a first end 20 and a second end 22. First ends 16 and 20 are electrically connected to one another at a terminal 24 of a signal source 26. Second ends 18 and 22 are electrically connected to one another at a terminal 28 of a load 30. The second conductor 14 is helically wound around the first conductor 12 and is at least three times and preferably at least five times longer than the first conductor. The length difference is selected to minimize reinforcement of resonant longitudinal electrical modes of the conductors. A preferred embodiment comprises an insulated solid or stranded 16-gauge primary conductor 12 with a single 20-gauge solid secondary conductor 14 helically wound around the primary conductor 12 at a rate of at least fifteen turns per inch. The length difference is approximately 7:1. The single length difference is at least 3:1 for high frequency components. A solid secondary conductor is preferred because multiple-strand conductors can cause signal nonlinearities called passive component intermodulation distortion attributed to the semiconducting phenomena at the surface-to-surface contact of multiple strands. Where the conductors 12 and 14 are electrically connected at the ends, the first conductor 12 and the second conductor 14 serve to detune one another, and thereby minimize the likelihood of sympathetic electrical ringing in each other.

Figure 2:
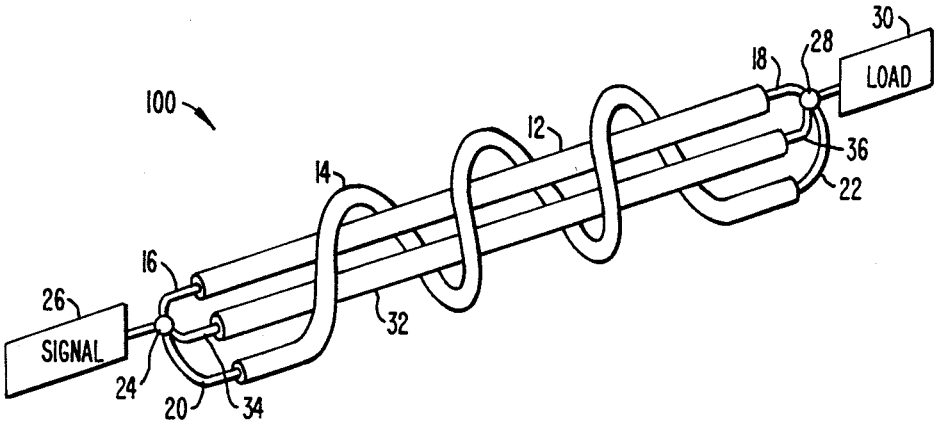
FIG. 2 is a side view of a first multiple wire, single conductor cable constructed in accordance with the invention.

Referring to FIG. 2, a multiple wire, single conductor cable 100 is constructed in accordance with a second embodiment of the invention. The numbering in FIG. 2 corresponds to the numbering of FIG. 1. In the embodiment of FIG. 2, the cable 100 comprises a first conductor 12, a second conductor 14 and a third conductor 32. The first conductor 12, the second conductor 14 and the third conductor 32 are all insulated wires. The third conductor 32 has a first end 34 terminating at the signal source terminal 24 and a second end 36 terminating at the load terminal 28. The third conductor 32 is of substantially the same length as the first conductor 12, both of which are insulated from one another along their lengths. This configuration is suitable for higher current applications and has the advantage of lowering the effective resistance of the shortest signal path without substantially increasing the mechanical rigidity of the cable 100 relative to a dual wire cable.

Figure 3:
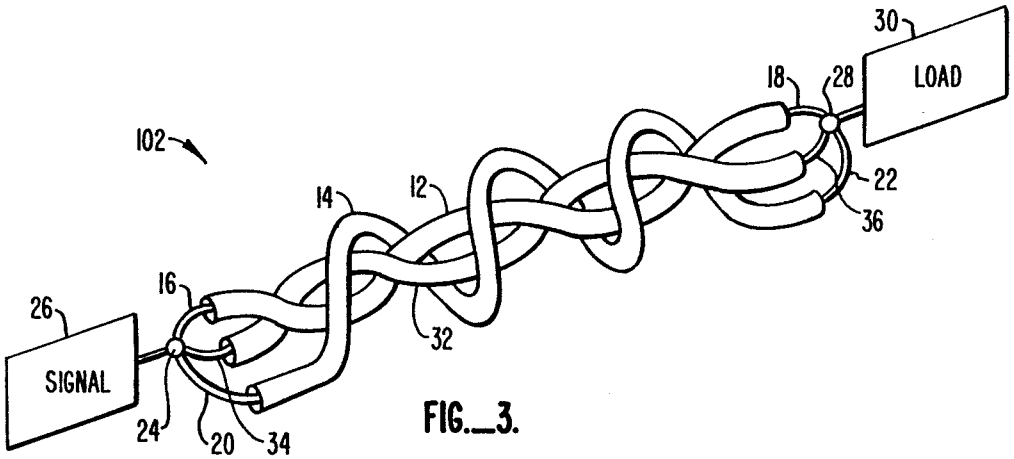
FIG. 3 is a side view of another multiple wire, single conductor cable constructed in accordance with the invention.

Referring to FIG. 3, a multiple wire, single conductor cable 102 is constructed in accordance with a third embodiment of the invention. The numbering in FIG. 3 corresponds to the numbering of FIG. 2. In the embodiment of FIG. 3, the first conductor 12 and the third conductor 32 are helically twisted about one another. This twisted pair configuration takes advantage of the inherent advantages of twisted pair cables. The helically-twisted pair may be counter-helically wound to the helical winding of the second conductor 14, further reducing any coupling therebetween.

Figure 4:
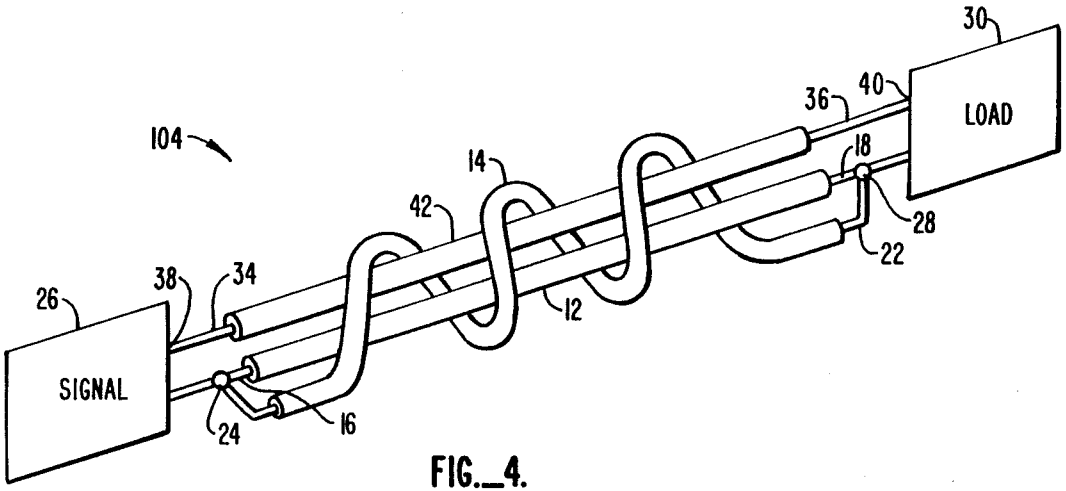
FIG. 4 is a side view of one multiple wire, dual conductor cable constructed in accordance with the invention.
Figure 5:
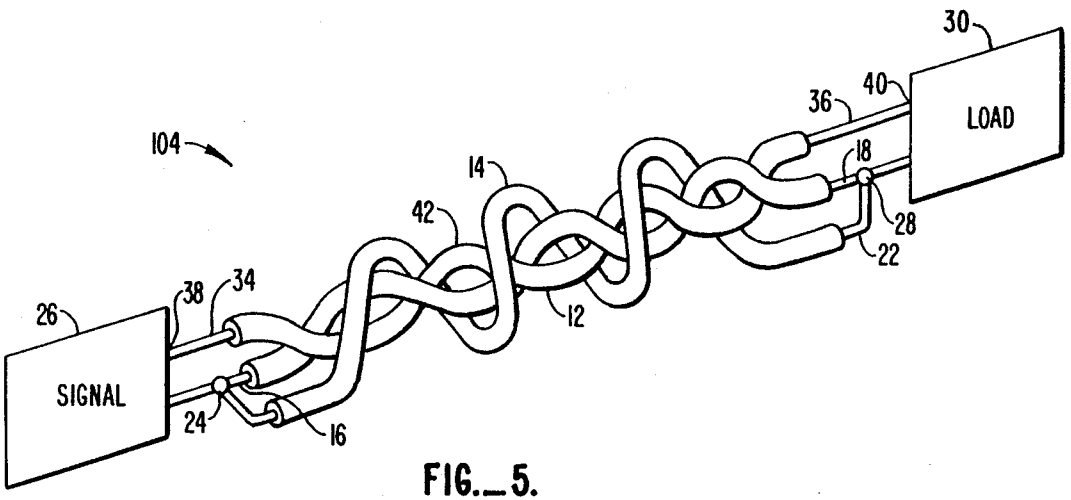
FIG. 5 is a side view of another multiple wire, dual conductor cable a constructed in accordance with the invention.

Referring to FIG. 4, a multiple wire, multiple conductor cable 104 is constructed in accordance with a fourth embodiment of the invention. The numbering in FIG. 4 corresponds to the numbering of FIG. 2. In the embodiment of FIG. 4, unlike any of FIGS. 1, 2 or 3, where a return is not shown, the cable 104 includes a third conductor 42 which has ends 34 and 36 which are not electrically terminated at terminals 24 and 28, respectively. The first end 34 is electrically terminated at a terminal 38 of signal source 26 and the second end 36 is terminated at a terminal 40 of load 30. The third conductor 42 serves as a signal return between the load 30 and the signal source 26. Thus, signal and the signal return leads may be contained compactly within a single cable sheath. The first conductor 12 and the third conductor 42 may also be helically twisted about one another counter-helically to the second conductor 14 (FIG. 5) to take advantage of the inherent advantages of twisted pair cables.

The invention has now been explained with reference to specific embodiments. Other embodiments will be apparent to those of ordinary skill in this art in light of this disclosure. Therefore, it is not intended that this invention be limited except as indicated by the appended claims.

I claim:

1. An interconnection cable for audio frequency high fidelity applications for carrying a signal comprising:
   - a first conductor;
   - a second conductor disposed helically surrounding said first conductor and insulated from said first conductor;
   - said first conductor and said second conductor each having first ends electrically connected one another at a signal source and second ends electrically connected to one another at a load; and
   - said second conductor having a physical length substantially longer than said first conductor such that signal length of said second conductor is substantially greater than signal length of said first conductor in order to minimize lengthwise end to end resonance.

2. The cable according to claim 1 wherein said second conductor has an electrical signal length which is at least 3 times longer than an electrical signal length of said first conductor.

3. The cable according to claim 1 wherein said second conductor is at least 7 times longer than said first conductor.

4. The cable according to claim 1 further including a third conductor, said third conductor being electrically connected at a first end to said first conductor and said second conductor and electrically connected at a second end to said first conductor and said second conductor and wherein said second conductor is coiled around said first conductor and around said third conductor.

5. The cable according to claim 4 wherein said second conductor has an electrical signal length which is at least 3 times longer than said first conductor.

6. The cable according to claim 4 wherein said second conductor is at least 7 times longer than said first conductor.

7. The cable according to claim 4 wherein said first conductor and said third conductor are helically twisted about one another.

8. The cable according to claim 1 further including a third conductor, said third conductor being electrically connected at a first end to a signal source and connected at a second end to a load, said third conductor being insulated from said second conductor and said first conductor and wherein said second conductor is coiled around said first conductor and around said third conductor, the third conductor constrained to carry all signal components of a return signal 9. The cable according to claim wherein said second conductor has an electrical signal length which is at least 3 times longer than said first conductor.

10. The cable according to claim 8 wherein said second conductor is at least 7 times longer than said first conductor.

11. The cable according to claim 8 wherein said first conductor and said third conductor are helically twisted about one another.

* * * * *